US010720739B1

(12) United States Patent
Wu et al.

(10) Patent No.: US 10,720,739 B1
(45) Date of Patent: Jul. 21, 2020

(54) ELECTRICAL CONNECTOR

(71) Applicant: Cheng Uei Precision Industry Co., LTD., New Taipei (TW)

(72) Inventors: Yun Wu, Dong-Guan (CN); Hsin-Min Chao, New Taipei (TW)

(73) Assignee: CHENG UEI PRECISION INDUSTRY CO., LD., New Taipei (TW)

( * ) Notice: Subject to any disclaimer, the term of this patent is extended or adjusted under 35 U.S.C. 154(b) by 0 days.

(21) Appl. No.: 16/589,090

(22) Filed: Sep. 30, 2019

(30) Foreign Application Priority Data

Apr. 16, 2019 (CN) ..... 2019 2 0519226 U

(51) Int. Cl.

| | |
|---|---|
| ***H01R 13/648*** | (2006.01) |
| ***H01R 24/62*** | (2011.01) |
| ***H01R 13/502*** | (2006.01) |
| ***H01R 13/405*** | (2006.01) |
| *H01R 107/00* | (2006.01) |

(52) U.S. Cl.
CPC ..... *H01R 24/62* (2013.01); *H01R 13/405* (2013.01); *H01R 13/502* (2013.01); *H01R 2107/00* (2013.01)

(58) Field of Classification Search
CPC ..... H01R 13/65802; H01R 13/658; H01R 23/6873; H01R 23/688
USPC ..... 439/607.01–607.59, 95, 108
See application file for complete search history.

(56) References Cited

U.S. PATENT DOCUMENTS

| | | | | |
|---|---|---|---|---|
| 5,637,014 | A * | 6/1997 | Sukegawa | H01R 23/6873 439/607.4 |
| 8,461,465 | B2 * | 6/2013 | Golko | H01R 13/642 174/359 |
| 9,077,096 | B2 * | 7/2015 | Simmel | H01R 13/502 |
| 9,478,905 | B2 * | 10/2016 | Golko | H01R 13/658 |
| 2016/0181746 | A1 * | 6/2016 | Simmel | H01R 13/502 439/607.01 |
| 2017/0077654 | A1 * | 3/2017 | Yao | H01R 13/405 |
| 2018/0366872 | A1 * | 12/2018 | Golko | H01R 13/62 |

* cited by examiner

*Primary Examiner* — Phuong Chi Thi Nguyen
(74) *Attorney, Agent, or Firm* — Cheng-Ju Chiang

(57) ABSTRACT

An electrical connector includes an insulating housing, a center plate fastened in the insulating housing, and a terminal assembly fastened in the insulating housing. The center plate has a base plate. Rears of two opposite sides of the base plate are connected with two connecting feet. A pair of the bending arms are connected with the rears of the two opposite sides of the base plate. The pair of the bending arms have two bending portions, two extending arms and two hooking portions. The two extending arms include two first extending portions, two connecting portions and two second extending portions. The two hooking portions have two first bending feet, two second bending feet and two third bending feet. The two connecting portions and the two second extending portions are exposed out of the insulating housing. The two first bending feet are exposed out of the insulating housing.

17 Claims, 4 Drawing Sheets

ELECTRICAL CONNECTOR

CROSS-REFERENCE TO RELATED APPLICATION

The present application is based on, and claims priority from, China Patent Application No. 201920519226.0, filed Apr. 16, 2019, the disclosure of which is hereby incorporated by reference herein in its entirety.

BACKGROUND OF THE INVENTION

1. Field of the Invention

The present invention generally relates to a connector, and more particularly to an electrical connector having a better structure strength.

2. The Related Art

In various connector types used by various electronic products frequently, universal serial bus (USB) connectors are applied at most, with the improvement of science and technology, kinds of the universal serial bus connectors are more and more, such as USB 2.0, USB 3.0, Micro USB, Mini USB or USB TYPE-C, the USB TYPE-C connectors have been widely applied in the various electronic products.

However, center plates of the current USB TYPE-C connectors adopt full plane designs, when the USB TYPE-C connectors are inserted into or withdrawn from docking connectors, because the USB TYPE-C connectors are lack of structure strengths, the USB TYPE-C connectors easily sway leftward and rightward, plastic materials and terminals of the USB TYPE-C connectors are pulled to be broken and deformed, thereby a damage phenomenon of the USB TYPE-C connectors are caused to be happened.

Thus, it is essential to provide an innovative electrical connector having a better structure strength.

SUMMARY OF THE INVENTION

An object of the present invention is to provide an electrical connector. The electrical connector includes an insulating housing, a center plate fastened in the insulating housing, and a terminal assembly fastened in the insulating housing. The center plate has a base plate received in the insulating housing. A rear of one side of the base plate is connected with at least one bending arm. A clamping angle is formed between the base plate and the at least one bending arm. The at least one bending arm has a bending portion bent and extended from the rear of the one side of the base plate and received in the insulating housing. A front end of the bending portion is slantwise extended frontward and downward, and then extended frontward to form a first extending portion received in the insulating housing. A front end of the first extending portion extends frontward to form a connecting portion exposed out of one side surface of the insulating housing. A front end of the connecting portion extends frontward to form a second extending portion exposed out of the one side surface of the insulating housing. A front end of the second extending portion is slantwise bent frontward and outward, and then extend frontward to form a first bending foot exposed out of the one side surface of the insulating housing. A front end of the first bending foot is bent towards the base plate to form a second bending foot received in the insulating housing. A tail end of the second bending foot is bent rearward towards a root portion of the bending portion to form a third bending foot received in the insulating housing. The center plate is mounted in a middle of the terminal assembly.

Another object of the present invention is to provide an electrical connector. The electrical connector includes an insulating housing, a center plate fastened in the insulating housing, and a terminal assembly fastened in the insulating housing. The center plate has a base plate. Rears of two opposite sides of the base plate are connected with two connecting feet. A pair of the bending arms are connected with the rears of the two opposite sides of the base plate and located in front of the two connecting feet. Top portions of the pair of the bending arms extend upward perpendicular to the base plate. The pair of the bending arms are disposed to fronts of two opposite sides of the insulating housing. The pair of the bending arms have two bending portions bent upward and extended perpendicular to the base plate from the rears of the two opposite sides of the base plate, two extending arms slantwise extended frontward and downward, and then extended frontward from front ends of the two bending portions, and two hooking portions slantwise extended frontward and outward, then extended frontward, further bent towards the base plate and bent rearward from front ends of the two extending arms. The two extending arms include two first extending portions slantwise extended frontward and downward, and then extended frontward from front ends of the two bending portions, two connecting portions extended frontward from front ends of the two first extending portions, and two second extending portions extended frontward from front ends of the two connecting portions. The two hooking portions have two first bending feet slantwise bent frontward and outward, and then extended frontward from front ends of the two second extending portions, two second bending feet bent towards the base plate from front ends of the two first bending feet, and two third bending feet bent rearward towards root portions of the two bending portions from tail ends of the two second bending feet. The two connecting portions and the two second extending portions are exposed out of two opposite sides of the insulating housing. The two first bending feet are exposed out of the two opposite sides of the insulating housing. The center plate is mounted in a middle of the terminal assembly.

Another object of the present invention is to provide an electrical connector. The electrical connector includes an insulating housing, a center plate fastened in the insulating housing, a metal plate assembly mounted to two opposite surfaces of the insulating housing, and a terminal assembly fastened in the insulating housing. The center plate has a base plate. Rears of two opposite sides of the base plate are connected with two connecting feet. A pair of the bending arms are connected with the rears of the two opposite sides of the base plate and located in front of the two connecting feet. Top portions of the pair of the bending arms extend upward perpendicular to the base plate. The pair of the bending arms are disposed to fronts of two opposite sides of the insulating housing. The pair of the bending arms have two bending portions bent upward and extended perpendicular to the base plate from the rears of the two opposite sides of the base plate, two extending arms slantwise extended frontward and downward, and then extended frontward from front ends of the two bending portions, and two hooking portions slantwise extended frontward and outward, then extended frontward, further bent towards the base plate and bent rearward from front ends of the two extending arms. The two extending arms include two first extending portions slantwise extended frontward and downward, and then extended frontward from front ends of the two bending portions, two connecting portions extended frontward from front ends of the two first extending portions, and two second extending portions extended frontward from front ends of the two connecting portions. The two hooking portions have two first bending feet slantwise bent frontward and outward, and then extended frontward from front ends of the two second extending portions, two second bending feet bent towards the base plate from front ends of the two first bending feet, and two third bending feet bent rearward towards root portions of the two bending portions from tail ends of the two second bending feet. The two connecting portions and the two second extending portions are exposed out of two opposite sides of the insulating housing. The two first bending feet are exposed out of the two opposite sides of the insulating housing. The center plate is mounted in a middle of the terminal assembly.

As described above, top portions of the pair of the bending arms of the center plate extend upward perpendicular to the base plate, the two hooking portions are formed by the two first bending feet, the two second bending feet and the two third bending feet for reinforcing a structure strength of the center plate, the two bending portions are received in a shell and the two first extending portions are received in the shell for locating and fastening the center plate, the two connecting portions and the two second extending portions are exposed out of the two opposite sides of the insulating housing, the two connecting portions and the two second extending portions are exposed out of two opposite sides of the shell, two protrusions of a front base portion of the insulating housing are inserted into two perforations for locating and fastening the center plate to the insulating housing, the two first bending feet are exposed out of the two opposite sides of the insulating housing, the two first bending feet are exposed out of the two opposite sides of the shell and two opposite sides of the front base portion of the insulating housing, the two second bending feet and the two third bending feet are fastened in the front base portion and the shell of the insulating housing for realizing a location and a fixation between the center plate and the insulating housing, and reinforcing the structure strength of the electrical connector. Furthermore, when the electrical connector is inserted or withdrawn, the center plate forms a stereo structure by virtue of the top portions of the pair of the bending arms being perpendicular to the base plate, consequently, the front base portion and the terminal assembly are prevented from being broken or deformed in the process of the electrical connector being inserted or withdrawn, and the electrical connector is prevented from being caused to be damaged. As a result, a strength effect of the electrical connector has a better improvement, and correspondingly the electrical connector has a better structure strength.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
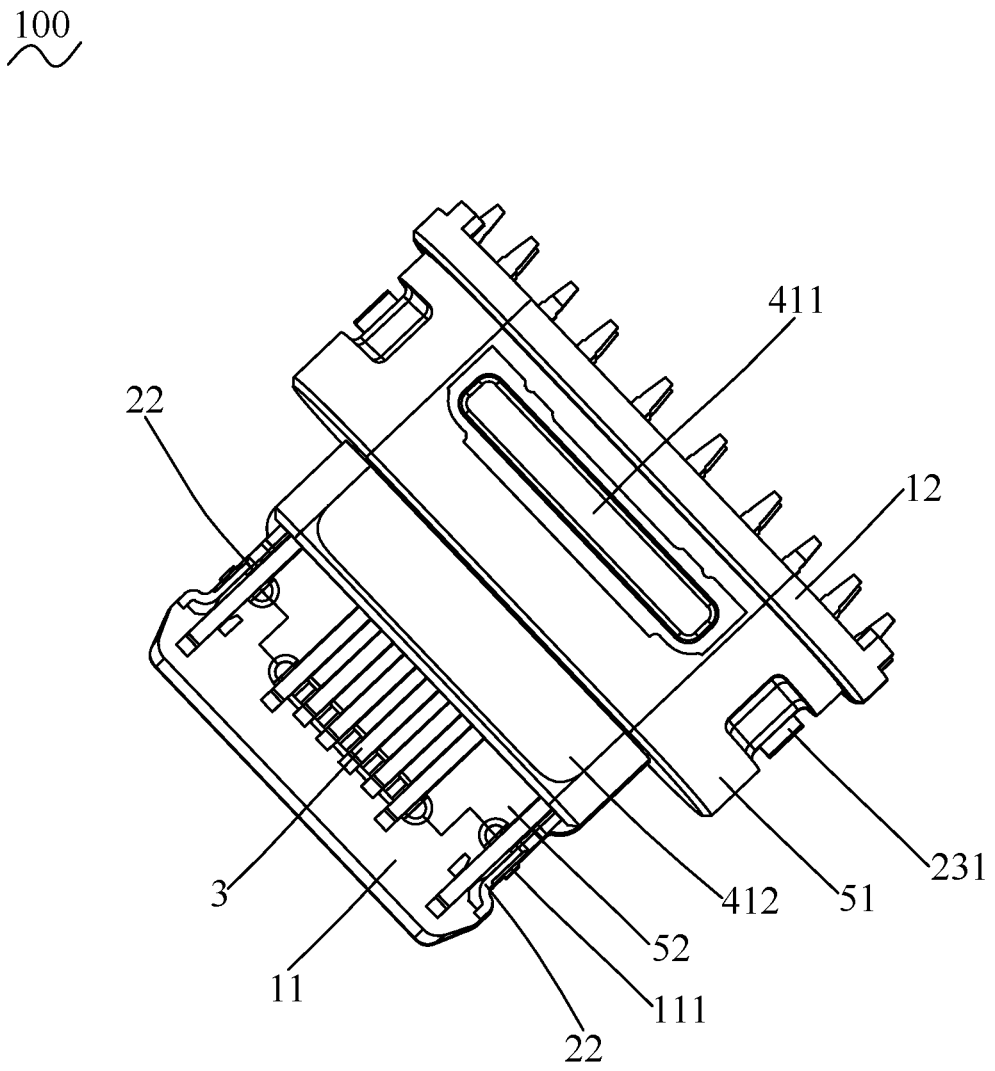
FIG. 1 is a perspective view of an electrical connector in accordance with a preferred embodiment of the present invention.

With reference to FIG. 1 to FIG. 4, an electrical connector 100 in accordance with a preferred embodiment of the present invention is shown. The electrical connector 100 includes an insulating housing 1, a center plate 2, a terminal assembly 3 and a metal plate assembly 4. The terminal assembly 3 is fastened in the insulating housing 1. The center plate 2 is mounted in a middle of the terminal assembly 3 and is fastened in the insulating housing 1. The metal plate assembly 4 are mounted to two opposite surfaces of the insulating housing 1. In the preferred embodiment, the electrical connector 100 is a TYPE-C connector. In another specific embodiment of the present invention, the electrical connector 100 is another type connector which is different from the TYPE-C connector.

Figure 2:
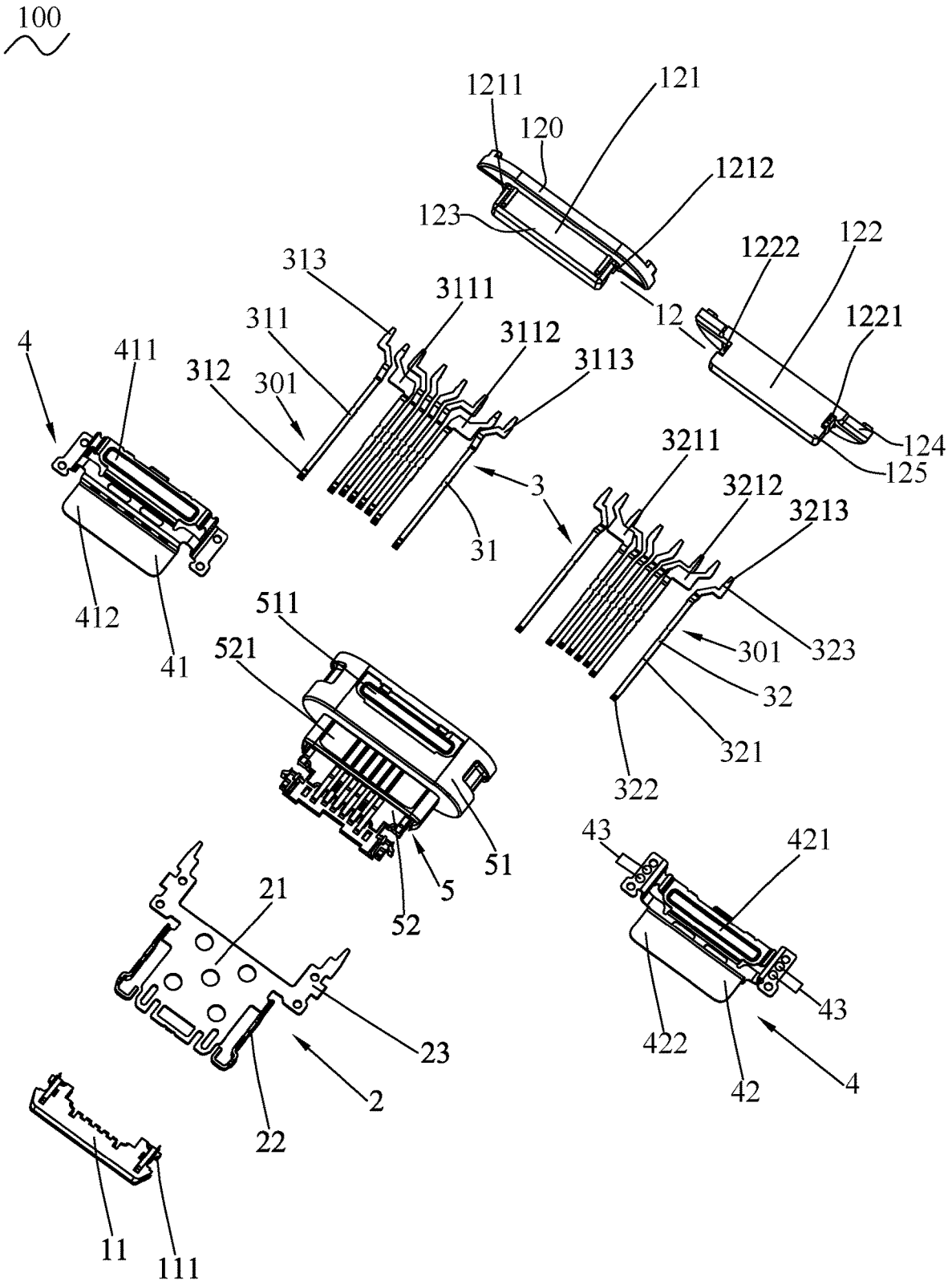
FIG. 2 is an exploded view of the electrical connector of FIG. 1.
Figure 3:
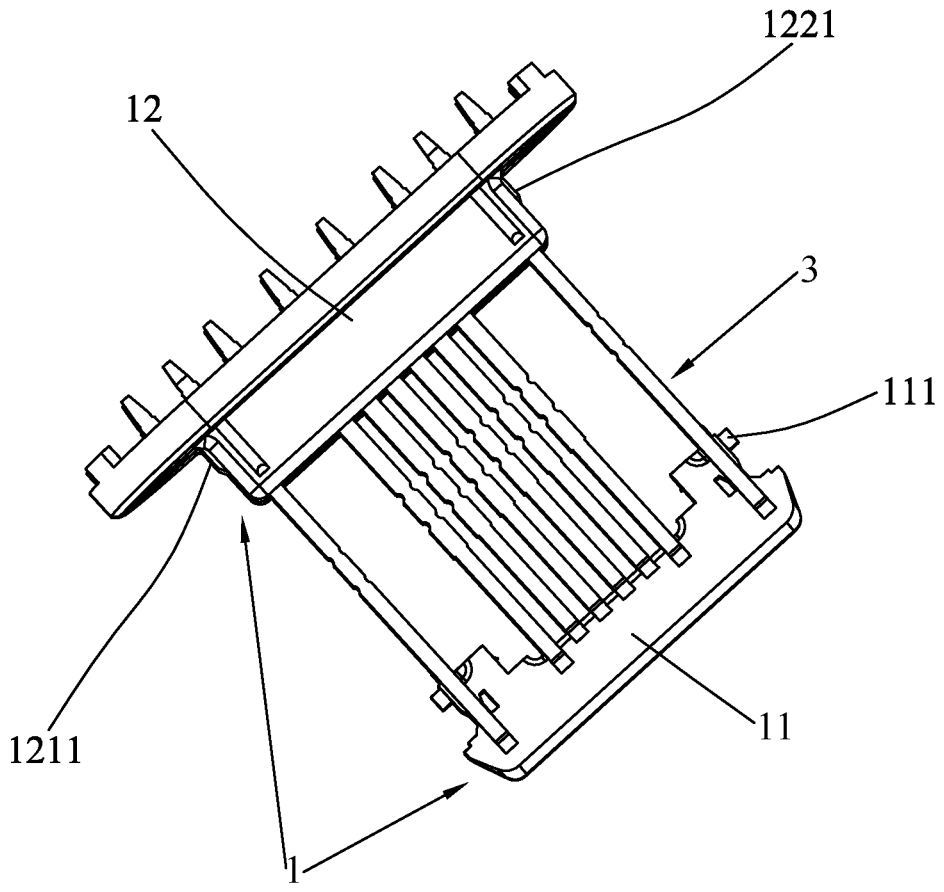
FIG. 3 is an assembling perspective view showing an insulating housing and a terminal assembly of the electrical connector of FIG. 1.

Referring to FIG. 1 to FIG. 3, the insulating housing 1 has a front base portion 11, a rear base portion 12 and a shell 5. The front base portion 11 is disposed to a front end of the center plate 2, a front end of the terminal assembly 3 and a front end of the shell 5. Two opposite sides of a rear end of the front base portion 11 protrude oppositely to form two protrusions 111. The two protrusions 111 penetrate through corresponding structures of the center plate 2 for realizing a location and a fixation between the insulating housing 1 and the center plate 2. The rear base portion 12 includes an upper base body 121 and a lower base body 122. A bottom surface of the upper base body 121 is matched with a top surface of the lower base body 122. The upper base body 121 is overlapped with the lower base body 122 by virtue of the bottom surface of the upper base body 121 being cooperated with the top surface of the lower base body 122. The upper base body 121 has a first assembling portion 120, and a first tongue portion 123 protruded frontward from a middle of a front surface of the first assembling portion 120. A rear of one side of the first tongue portion 123 protrudes downward to form an upper buckling portion 1211 projecting under a bottom surface of the upper base body 121. A lower portion of a rear of the other side of the first tongue portion 123 is recessed inward to form an upper buckling groove 1212 penetrating through the bottom surface of the upper base body 121. The lower base body 122 has a second assembling portion 124, and a second tongue portion 125 protruded frontward from a middle of a front surface of the second assembling portion 124. An upper portion of a rear of one side of the second assembling portion 124 is recessed inward to form a lower buckling groove 1222 penetrating through a top surface of the lower base body 122 and corresponding to the upper buckling portion 1211. A rear of the other side of the second assembling portion 124 protrudes upward to form a lower buckling portion 1221 projecting beyond the top surface of the lower base body 122 and corresponding to the upper buckling groove 1212.

The upper buckling portion 1211 is disposed to a rear of one side of the bottom surface of the upper base body 121. The upper buckling groove 1212 is formed at a rear of the other side of the bottom surface of the upper base body 121. The lower buckling groove 1222 is formed at a rear of one side of the top surface of the lower base body 122. The lower buckling portion 1221 is disposed to a rear of the other side of the top surface of the lower base body 122. The upper buckling portion 1211 is buckled in the lower buckling groove 1222. The lower buckling portion 1221 is buckled in the upper buckling groove 1212. So a location and a fixation between the upper base body 121 and the lower base body 122 are realized.

Figure 4:
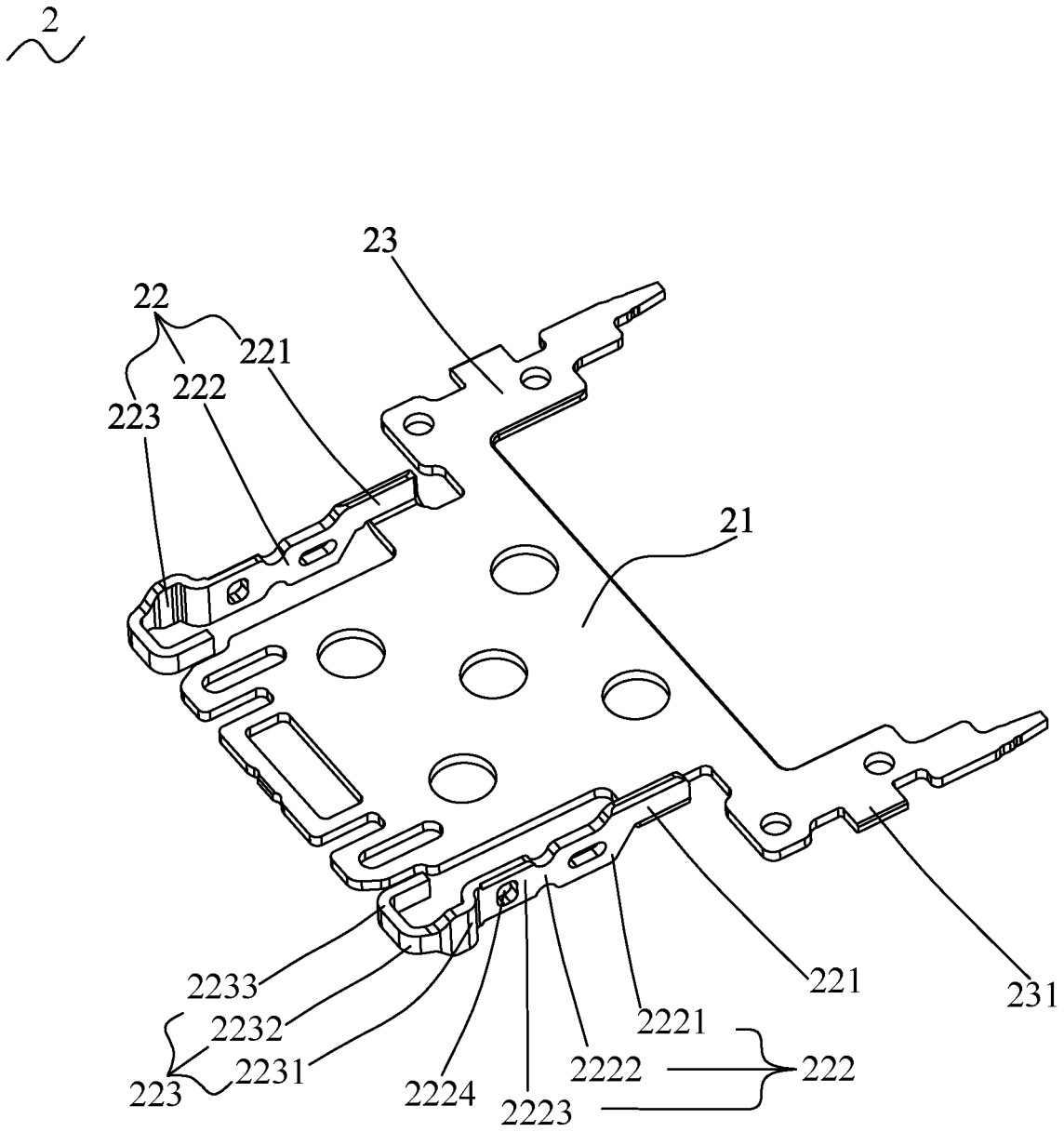
FIG. 4 is a perspective view of a center plate of the electrical connector in accordance with the preferred embodiment of the present invention.

Referring to FIG. 1, FIG. 2 and FIG. 4, the center plate 2 has a base plate 21. A rear of one side of the base plate 21 is connected with at least one bending arm 22. A clamping angle is formed between the base plate 21 and the at least one bending arm 22. The at least one bending arm 22 has a bending portion 221 bent and extended from the rear of the one side of the base plate 21 and received in the insulating housing 1, an extending arm 222 connected with a front end of the bending portion 221, and a hooking portion 223 connected with a front end of the extending arm 222. The front end of the bending portion 221 is slantwise extended frontward and downward, and then extended frontward to form a first extending portion 2221 received in the insulating housing 1. A front end of the first extending portion 2221 extends frontward to form a connecting portion 2222 exposed out of one side surface of the insulating housing 1. A front end of the connecting portion 2222 extend frontward to form a second extending portion 2223 exposed out of the one side surface of the insulating housing 1. The extending arm 222 includes the first extending portion 2221, the connecting portion 2222 and the second extending portion 2223. A front end of the second extending portion 2223 is slantwise bent frontward and outward, and then extends frontward to form a first bending foot 2231 exposed out of the one side surface of the insulating housing 1. A front end of the first bending foot 2231 is bent towards the base plate 21 to form a second bending foot 2232 received in the insulating housing 1. A tail end of the second bending foot 2232 is bent rearward towards a root portion of the bending portion 221 to form a third bending foot 2233 received in the insulating housing 1. The hooking portion 223 includes the first bending foot 2231, the second bending foot 2232 and the third bending foot 2233. Specifically, rears of two opposite sides of the base plate 21 are connected with two connecting feet 23. A pair of the bending arms 22 are connected with the rears of the two opposite sides of the base plate 21 and located in front of the two connecting feet 23. Top portions of the pair of the bending arms 22 of the center plate 2 extend upward perpendicular to the base plate 21. The pair of the bending arms 22 are disposed to fronts of two opposite sides of the insulating housing 1. The pair of the bending arms 22 are transversely disposed by a mirror image way. Middles of two outer sides of the two connecting feet 23 protrude oppositely to form two protruding pieces 231. The pair of the bending arms 22 have two bending portions 221 bent upward and extended perpendicular to the base plate 21 from the rears of the two opposite sides of the base plate 21, two extending arms 222 slantwise extended frontward and downward, and then extended frontward from front ends of the two bending portions 221, and two hooking portions 223 slantwise extended frontward and outward, then extended frontward, further bent towards the base plate 21 and bent rearward from front ends of the two extending arms 222. The two extending arms 222 include two first extending portions 2221 slantwise extended frontward and downward, and then extended frontward from front ends of the two bending portions 221, two connecting portions 2222 extended frontward from front ends of the two first extending portions 2221, and two second extending portions 2223 extended frontward from front ends of the two connecting portions 2222. Top surfaces and bottom surfaces of the two connecting portions 2222 are recessed inward. The two second extending portions 2223 open two perforations 2224. The two hooking portions 223 have two first bending feet 2231 slantwise bent frontward and outward, and then extended frontward from front ends of the two second extending portions 2223, two second bending feet 2232 bent towards the base plate 21 from front ends of the two first bending feet 2231, and two third bending feet 2233 bent rearward towards root portions of the two bending portions 221 from tail ends of the two second bending feet 2232. In the preferred embodiment of the present invention, the front ends of the two first bending feet 2231 are bent inward to form the two second bending feet 2232. Free ends of the two second bending feet 2232 are bent rearward towards the root portions of the two bending portions 221 to form the two third bending feet 2233.

The two first extending portions 2221, the two connecting portions 2222, the two second extending portions 2223 and the two perforations 2224 form the two extending arms 222, respectively. The two first bending feet 2231, the two second bending feet 2232 and the two third bending feet 2233 form the two hooking portions 223, respectively. The two bending portions 221, the two extending arms 222 and the two hooking portions 223 form the two bending arms 22, respectively. The two connecting portions 2222 are of pieces shape, and the two connecting portions 2222 are connected between the front ends of the two first extending portions 2221 and rear ends of the two second extending portions 2223. The two bending arms 22 are extended upward perpendicular to the base plate 21.

The base plate 21 is received in the shell 5 of the insulating housing 1. The two bending portions 221 are received in the shell 5 for locating and fastening the center plate 2. The two first extending portions 2221 are received in the shell 5 for locating and fastening the center plate 2. The two connecting portions 2222 and the two second extending portions 2223 are exposed out of two opposite sides of the shell 5. Specifically, the two connecting portions 2222 and the two second extending portions 2223 are exposed out of a left side and a right side of the shell 5. The two second extending portions 2223 open the two perforations 2224. The two protrusions 111 of the front base portion 11 of the insulating housing 1 are inserted into the two perforations 2224 for locating and fastening the center plate 2 to the insulating housing 1. The two first bending feet 2231 are exposed out of two opposite sides of the shell 5 and two opposite sides of the front base portion 11 of the insulating housing 1. Specifically, the two first bending feet 2231 are exposed out of a left side and a right side of the shell 5 and a left side and a right side of the front base portion 11 of the insulating housing 1. The two second bending feet 2232 and the two third bending feet 2233 are fastened in the front base portion 11 and the shell 5 of the insulating housing 1 for realizing the location and the fixation between the center plate 2 and the insulating housing 1 and reinforcing a structure strength of the electrical connector 100.

When the electrical connector 100 is inserted or withdrawn, the center plate 2 forms a stereo structure by virtue of the top portions of the pair of the bending arms 22 being perpendicular to the base plate 21, so that the structure strength of the electrical connector 100 is reinforced, consequently, the front base portion 11 and the terminal assembly 3 are prevented from being broken or deformed in a process of the electrical connector 100 being inserted or withdrawn, and the electrical connector 100 is prevented from being caused to be damaged. The two hooking portions 223 are formed by the two first bending feet 2231, the two second bending feet 2232 and the two third bending feet 2233 for reinforcing the structure strength of the center plate 2, so that the structure strength of the electrical connector 100 is reinforced.

In the preferred embodiment, the rears of the two opposite sides of the base plate 21 protrude oppositely and extend rearward to form the two connecting feet 23, specifically, rear ends of a left side and a right side of the base plate 21 protrude oppositely and extend rearward to form the two connecting feet 23, the two connecting feet 23 are received in the shell 5. Tail ends of the two connecting feet 23 penetrate rearward through the rear base portion 12 and are exposed beyond a rear surface of the rear base portion 12. The two protruding pieces 231 are exposed out of rear ends of two side surfaces of the shell 5.

Referring to FIG. 1 to FIG. 3, the terminal assembly 3 is integrated with and is disposed in the insulating housing 1 by virtue of an injection molding technology. The terminal assembly 3 includes a plurality of terminals 301. The plurality of the terminals 301 include a plurality of upper terminals 31 and a plurality of lower terminals 32. The plurality of the upper terminals 31 include a first upper terminal 3111, a second upper terminal 3112 and at least one upper ground terminal 3113. In the preferred embodiment, the plurality of the upper terminals 31 include two upper ground terminals 3113. The plurality of the lower terminals 32 include a first lower terminal 3211, a second lower terminal 3212 and at least one lower ground terminal 3213. In the preferred embodiment, the plurality of the lower terminals 32 include two lower ground terminals 3213. Each upper terminal 31 has an upper fastening portion 311, an upper contact portion 312 connected with a front end of the upper fastening portion 311, and an upper soldering portion 313 connected with a rear end of the upper fastening portion 311. Each lower terminal 32 has a lower fastening portion 321, a lower contact portion 322 connected with a front end of the lower fastening portion 321, and a lower soldering portion 323 connected with a rear end of the lower fastening portion 321.

The plurality of the upper terminals 31 are fastened in the upper base body 121 of the insulating housing 1. In the preferred embodiment, the plurality of the upper terminals 31 are molded in the upper base body 121 of the insulating housing 1. The upper fastening portions 311 of the plurality of the upper terminals 31 are fastened in and surrounded by the upper base body 121. The front ends of the upper fastening portions 311 of the plurality of the upper terminals 31 extend frontward to form the upper contact portions 312 projecting beyond a front surface of the upper base body 121. The front ends of the upper contact portions 312 of the plurality of the upper terminals 31 are surrounded by the front base portion 11 of the insulating housing 1. The rear ends of the upper fastening portions 311 of the plurality of the upper terminals 31 extend rearward to form the upper soldering portions 313 projecting beyond a rear surface of the upper base body 121 of the insulating housing 1.

The plurality of the lower terminals 32 are fastened in the lower base body 122 of the insulating housing 1. In the preferred embodiment, the plurality of the lower terminals 32 are molded in the lower base body 122 of the insulating housing 1. The lower fastening portions 321 of the plurality of the lower terminals 32 are fastened in the lower base body 122. The front ends of the lower fastening portions 321 of the plurality of the lower terminals 32 extend frontward to form the lower contact portions 322 projecting beyond a front surface of the lower base body 122 of the insulating housing 1. Front ends of the lower contact portions 322 of the plurality of the lower terminals 32 are surrounded by the front base portion 11 of the insulating housing 1. The rear ends of the lower fastening portions 321 of the plurality of the lower terminals 32 extend rearward to form the lower soldering portions 323 projecting beyond a rear surface of the lower base body 122 of the insulating housing 1.

The first upper terminal 3111 of the plurality of the upper terminals 31 is partially exposed out of the bottom surface of the upper base body 121. The second upper terminal 3112 of the plurality of the upper terminals 31 is partially exposed out of the bottom surface of the upper base body 121. The first upper terminal 3111 and the second upper terminal 3112 are disposed symmetrical to each other along a left-to-right direction. The two upper ground terminals 3113 of the plurality of the upper terminals 31 are disposed symmetrical to each other along the left-to-right direction. The at least one upper ground terminal 3113 is located between the upper buckling portion 1211 and the upper buckling groove 1212. The two upper ground terminals 3113 are located to inner sides of the upper buckling portion 1211 and the upper buckling groove 1212. The first upper terminal 3111 and the second upper terminal 3112 are power terminals.

The first lower terminal 3211 of the plurality of the lower terminals 32 is located to and fastened to the top surface of the lower base body 122 and is partially exposed out of the top surface of the lower base body 122. The second lower terminal 3212 of the plurality of the lower terminals 32 is partially exposed out of the top surface of the lower base body 122. The two lower ground terminals 3213 of the plurality of the lower terminals 32 are disposed symmetrical to each other along the left-to-right direction. The at least one lower ground terminal 3213 of the plurality of the lower terminals 32 is located between the lower buckling portion 1221 and the lower buckling groove 1222. The two lower ground terminals 3213 of the plurality of the lower terminals 32 are located to inner sides of the lower buckling portion 1221 and the lower buckling groove 1222. The first lower terminal 3211 and the second lower terminal 3212 are the power terminals. In the preferred embodiment, the plurality of the upper terminals 31 and the plurality of the lower terminals 32 are vertically disposed by the mirror image way.

In the preferred embodiment, the plurality of the upper terminals 31 are located above the plurality of the lower terminals 32, and the upper soldering portions 313 of the plurality of upper terminals 31 are located above the lower soldering portions 323 of the plurality of the lower terminals 32. In order to save occupying space of the electrical connector 100, the upper soldering portion 313 of the second upper terminal 3112 is corresponding to and connected with the lower soldering portion 323 of the second lower terminal 3212, and the upper soldering portions 313 of the two upper ground terminals 3113 are corresponding to and connected with the lower soldering portions 323 of the two lower ground terminals 3213.

Referring to FIG. 1 and FIG. 2, the metal plate assembly 4 includes an upper plate 41 and a lower plate 42. The upper plate 41 is disposed above and surrounds the upper base body 121. The lower plate 42 is disposed under and surrounds the lower base body 122. The upper plate 41 is symmetrical to the lower plate 42 with respect to the center plate 2. Two opposite sides of the upper plate 41 are located to and fastened to top surfaces of the two connecting feet 23 of the center plate 2, and two opposite sides of the lower plate 42 are located to and fastened to bottom surfaces of the two connecting feet 23 of the center plate 2. The center plate 2 is soldered between the upper plate 41 and the lower plate 42, so a plurality of soldering spots 43 are formed among the upper plate 41, the center plate 2 and the lower plate 42.

A top surface of the upper plate 41 has a first location surface 411 located at a rear of the top surface of the upper plate 41, and a first plane 412 located in front of the first location surface 411 and is lower than the first location surface 411. The shell 5 is molded to the center plate 2 and the metal plate assembly 4. The upper plate 41 is received in the shell 5. The first location surface 411 and the first plane 412 are exposed to a top surface of the shell 5. A top surface of the lower plate 42 has a second location surface 421 located at a rear of the top surface of the lower plate 42, and a second plane 422 located in front of the second location surface 421 and exceeds the second location surface 421. The lower plate 42 is received in the shell 5. The second location surface 421 and the second plane 422 are exposed to a bottom surface of the shell 5.

Referring to FIG. 1 and FIG. 2, the shell 5 includes a surrounding barrel 51, a tongue board 52 extended frontward from a front surface of the surrounding barrel 51, two first concave surfaces 511 and two second concave surfaces 521. The rear base portion 12 and the terminal assembly 3 are fastened in the shell 5 of the insulating housing 1. The surrounding barrel 51 surrounds the rear base portion 12, a rear of the terminal assembly 3, a rear end of the center plate 2 and a rear of the metal plate assembly 4. The upper contact portions 312 of the plurality of the upper terminals 31 are exposed to a top surface of the tongue board 52. The lower contact portions 322 of the plurality of the lower terminals 32 are exposed to a bottom surface of the tongue board 52. The front base portion 11 of the insulating housing 1 is molded to a front end of the tongue board 52, the front ends of the upper contact portions 312 of the plurality of the upper terminals 31, the front ends of the lower contact portions 322 of the plurality of the lower terminals 32 and the front end of the center plate 2, so the front end of the tongue board 52, the front ends of the upper contact portions 312 of the plurality of the upper terminals 31, the front ends of the lower contact portions 322 of the plurality of the lower terminals 32 and the front end of the center plate 2 are surrounded by the front base portion 11 of the insulating housing 1. A top surface and a bottom surface of the surrounding barrel 51 has the two symmetrical first concave surfaces 511 with respect to a middle of the shell 5. The first location surface 411 and the second location surface 421 of the metal plate assembly 4 are located to the two first concave surfaces 511, respectively for realizing a location and a fixation between the metal plate assembly 4 and the shell 5. Rears of the top surface and the bottom surface of the tongue board 52 are recessed inward and towards the middle of the shell 5 to form two symmetrical second concave surfaces 521 with respect to the middle of the shell 5. The first plane 412 and the second plane 422 of the metal plate assembly 4 are located to the two second concave surfaces 521 for realizing the location and the fixation between the metal plate assembly 4 and the shell 5.

As described above, the top portions of the pair of the bending arms 22 of the center plate 2 of the electrical connector 100 extend upward perpendicular to the base plate 21, the two hooking portions 223 are formed by the two first bending feet 2231, the two second bending feet 2232 and the two third bending feet 2233 for reinforcing the structure strength of the center plate 2, the two bending portions 221 are received in the shell 5 and the two first extending portions 2221 are received in the shell 5 for locating and fastening the center plate 2, the two connecting portions 2222 and the two second extending portions 2223 are exposed out of the two opposite sides of the insulating housing 1, the two connecting portions 2222 and the two second extending portions 2223 are exposed out of two opposite sides of the shell 5, the two protrusions 111 of the front base portion 11 of the insulating housing 1 are inserted into the two perforations 2224 for locating and fastening the center plate 2 to the insulating housing 1, the two first bending feet 2231 are exposed out of the two opposite sides of the insulating housing 1, the two first bending feet 2231 are exposed out of the two opposite sides of the shell 5 and the two opposite sides of the front base portion 11 of the insulating housing 1, the two second bending feet 2232 and the two third bending feet 2233 are fastened in the front base portion 11 and the shell 5 of the insulating housing 1 for realizing the location and the fixation between the center plate 2 and the insulating housing 1, and reinforcing the structure strength of the electrical connector 100. Furthermore, when the electrical connector 100 is inserted or withdrawn, the center plate 2 forms the stereo structure by virtue of the top portions of the pair of the bending arms 22 being perpendicular to the base plate 21, consequently, the front base portion 11 and the terminal assembly 3 are prevented from being broken or deformed in the process of the electrical connector 100 being inserted or withdrawn, and the electrical connector 100 is prevented from being caused to be damaged. As a result, a strength effect of the electrical connector 100 has a better improvement, and correspondingly the electrical connector 100 has a better structure strength.

What is claimed is:

1. An electrical connector, comprising:

an insulating housing;

a center plate fastened in the insulating housing, the center plate having a base plate received in the insulating housing, a rear of one side of the base plate being connected with at least one bending arm, a clamping angle being formed between the base plate and the at least one bending arm, the at least one bending arm having a bending portion bent and extended from the rear of the one side of the base plate and received in the insulating housing, a front end of the bending portion being slantwise extended frontward and downward, and then extended frontward to form a first extending portion received in the insulating housing, a front end of the first extending portion extending frontward to form a connecting portion exposed out of one side surface of the insulating housing, a front end of the connecting portion extending frontward to form a second extending portion exposed out of the one side surface of the insulating housing, a front end of the second extending portion being slantwise bent frontward and outward, and then extending frontward to form a first bending foot exposed out of the one side surface of the insulating housing, a front end of the first bending foot being bent towards the base plate to form a second bending foot received in the insulating housing, a tail end of the second bending foot being bent rearward towards a root portion of the bending portion to form a third bending foot received in the insulating housing; and a terminal assembly fastened in the insulating housing, the center plate mounted in a middle of the terminal assembly.

2. The electrical connector as claimed in claim 1, wherein a pair of the bending arms are connected with rears of two opposite sides of the base plate, the pair of the bending arms are disposed to fronts of two opposite sides of the insulating housing.

3. The electrical connector as claimed in claim 2, wherein the pair of the bending arms are transversely disposed by a mirror image way.

4. The electrical connector as claimed in claim 2, wherein the pair of the bending arms have two bending portions bent upward and extended perpendicular to the base plate from the rears of the two opposite sides of the base plate, two extending arms slantwise extended frontward and downward, and then extended frontward from front ends of the two bending portions, and two hooking portions slantwise extended frontward and outward, then extended frontward, further bent towards the base plate and bent rearward from front ends of the two extending arms, the two extending arms include two first extending portions slantwise extended frontward and downward, and then extended frontward from front ends of the two bending portions, two connecting portions extended frontward from front ends of the two first extending portions, and two second extending portions extended frontward from front ends of the two connecting portions.

5. The electrical connector as claimed in claim 4, wherein the insulating housing has a front base portion, a rear base portion and a shell, the front base portion is disposed to a front end of the center plate, a front end of the terminal assembly and a front end of the shell, two opposite sides of a rear end of the front base portion protrude oppositely to form two protrusions, the two second extending portions open two perforations, the two protrusions are inserted into the two perforations.

6. The electrical connector as claimed in claim 5, wherein the rears of the two opposite sides of the base plate are connected with two connecting feet, the two connecting feet are received in the shell, tail ends of the two connecting feet penetrate rearward through the rear base portion and are exposed beyond a rear surface of the rear base portion, middles of two outer sides of the two connecting feet protrude oppositely to form two protruding pieces, the two protruding pieces are exposed out of rear ends of two side surfaces of the shell.

7. The electrical connector as claimed in claim 6, wherein the rear base portion includes an upper base body and a lower base body, the upper base body is overlapped with the lower base body by virtue of a bottom surface of the upper base body being cooperated with a top surface of the lower base body, the terminal assembly includes a plurality of terminals which include a plurality of upper terminals fastened in the upper base body, and a plurality of lower terminals fastened in the lower base body, the rear base portion and the terminal assembly are fastened in the shell of the insulating housing.

8. The electrical connector as claimed in claim 7, wherein the upper base body has a first assembling portion, and a first tongue portion protruded frontward from a front surface of the first assembling portion, a rear of one side of the first tongue portion protrudes downward to form an upper buckling portion projecting under a bottom surface of the upper base body, a lower portion of a rear of the other side of the first tongue portion is recessed inward to form an upper buckling groove penetrating through the bottom surface of the upper base body, the lower base body has a second assembling portion, and a second tongue portion protruded frontward from a front surface of the second assembling portion, an upper portion of a rear of one side of the second assembling portion is recessed inward to form a lower buckling groove penetrating through a top surface of the lower base body, a rear of the other side of the second assembling portion protrudes upward to form a lower buckling portion projecting beyond the top surface of the lower base body, the upper buckling portion is buckled in the lower buckling groove, the lower buckling portion is buckled in the upper buckling groove.

9. The electrical connector as claimed in claim 8, wherein the upper buckling portion is disposed to a rear of one side of the bottom surface of the upper base body, the upper buckling groove is formed at a rear of the other side of the bottom surface of the upper base body, the lower buckling groove is formed at a rear of one side of the top surface of the lower base body, the lower buckling portion is disposed to a rear of the other side of the top surface of the lower base body.

10. The electrical connector as claimed in claim 8, wherein the plurality of the upper terminals include at least one upper ground terminal, the plurality of the lower terminals include at least one lower ground terminal, the at least one upper ground terminal is located between the upper buckling portion and the upper buckling groove, the at least one lower ground terminal is located between the lower buckling portion and the lower buckling groove.

11. The electrical connector as claimed in claim 8, wherein the plurality of the upper terminals include two upper ground terminals, the plurality of the lower terminals include two lower ground terminals, the two upper ground terminals are located to inner sides of the upper buckling portion and the upper buckling groove, the two lower ground terminals of the plurality of the lower terminals are located to inner sides of the lower buckling portion and the lower buckling groove.

12. The electrical connector as claimed in claim 7, further comprising a metal plate assembly mounted to two opposite surfaces of the insulating housing, the metal plate assembly including an upper plate and a lower plate, the upper plate being disposed above and surrounding the upper base body, the lower plate being disposed under and surrounding the lower base body, the upper plate being symmetrical to the lower plate with respect to the center plate, two opposite sides of the upper plate being located to and fastened to top surfaces of the two connecting feet of the center plate, and two opposite sides of the lower plate being located to and fastened to bottom surfaces of the two connecting feet of the center plate.

13. The electrical connector as claimed in claim 12, wherein the center plate is soldered between the upper plate and the lower plate, so a plurality of soldering spots are formed among the upper plate, the center plate and the lower plate.

14. The electrical connector as claimed in claim 12, wherein a top surface of the upper plate has a first location surface located at a rear of the top surface of the upper plate, and a first plane located in front of the first location surface and is lower than the first location surface, the upper plate is received in the shell, the first location surface and the first plane are exposed to a top surface of the shell, a top surface of the lower plate has a second location surface located at a rear of the top surface of the lower plate, and a second plane located in front of the second location surface and exceeds the second location surface, the lower plate is received in the shell, the second location surface and the second plane are exposed to a bottom surface of the shell.

15. The electrical connector as claimed in claim 14, wherein the shell includes a surrounding barrel, and a tongue board extended frontward from a front surface of the surrounding barrel, a top surface and a bottom surface of the surrounding barrel has the two symmetrical first concave surfaces with respect to a middle of the shell, the first location surface and the second location surface are located to the two first concave surfaces, respectively, rears of a top surface and a bottom surface of the tongue board are recessed inward and towards the middle of the shell to form two symmetrical second concave surfaces with respect to the middle of the shell, the first plane and the second plane are located to the two second concave surfaces.

16. An electrical connector, comprising:

an insulating housing;

a center plate fastened in the insulating housing, the center plate having a base plate, rears of two opposite sides of the base plate being connected with two connecting feet, a pair of the bending arms being connected with the rears of the two opposite sides of the base plate and located in front of the two connecting feet, top portions of the pair of the bending arms extending upward perpendicular to the base plate, the pair of the bending arms being disposed to fronts of two opposite sides of the insulating housing, the pair of the bending arms having two bending portions bent upward and extended perpendicular to the base plate from the rears of the two opposite sides of the base plate, two extending arms slantwise extended frontward and downward, and then extended frontward from front ends of the two bending portions, and two hooking portions slantwise extended frontward and outward, then extended frontward, further bent towards the base plate and bent rearward from front ends of the two extending arms, the two extending arms including two first extending portions slantwise extended frontward and downward, and then extended frontward from front ends of the two bending portions, two connecting portions extended frontward from front ends of the two first extending portions, and two second extending portions extended frontward from front ends of the two connecting portions, the two hooking portions having two first bending feet slantwise bent frontward and outward, and then extended frontward from front ends of the two second extending portions, two second bending feet bent towards the base plate from front ends of the two first bending feet, and two third bending feet bent rearward towards root portions of the two bending portions from tail ends of the two second bending feet, the two connecting portions and the two second extending portions being exposed out of two opposite sides of the insulating housing, the two first bending feet being exposed out of the two opposite sides of the insulating housing; and a terminal assembly fastened in the insulating housing, the center plate mounted in a middle of the terminal assembly.

17. An electrical connector, comprising:

an insulating housing;

a center plate fastened in the insulating housing, the center plate having a base plate, rears of two opposite sides of the base plate being connected with two connecting feet, a pair of the bending arms being connected with the rears of the two opposite sides of the base plate and located in front of the two connecting feet, top portions of the pair of the bending arms extending upward perpendicular to the base plate, the pair of the bending arms being disposed to fronts of two opposite sides of the insulating housing, the pair of the bending arms having two bending portions bent upward and extended perpendicular to the base plate from the rears of the two opposite sides of the base plate, two extending arms slantwise extended frontward and downward, and then extended frontward from front ends of the two bending portions, and two hooking portions slantwise extended frontward and outward, then extended frontward, further bent towards the base plate and bent rearward from front ends of the two extending arms, the two extending arms including two first extending portions slantwise extended frontward and downward, and then extended frontward from front ends of the two bending portions, two connecting portions extended frontward from front ends of the two first extending portions, and two second extending portions extended frontward from front ends of the two connecting portions, the two hooking portions having two first bending feet slantwise bent frontward and outward, and then extended frontward from front ends of the two second extending portions, two second bending feet bent towards the base plate from front ends of the two first bending feet, and two third bending feet bent rearward towards root portions of the two bending portions from tail ends of the two second bending feet, the two connecting portions and the two second extending portions being exposed out of two opposite sides of the insulating housing, the two first bending feet being exposed out of the two opposite sides of the insulating housing;

a metal plate assembly mounted to two opposite surfaces of the insulating housing; and a terminal assembly fastened in the insulating housing, the center plate mounted in a middle of the terminal assembly.

* * * * *